United States Patent [19]

Arnold

[11] 4,190,122

[45] Feb. 26, 1980

[54] SPACED WEIGHT RELIEVED DRILL COLLAR STRING

[76] Inventor: James F. Arnold, 241 Kilts Dr., Houston, Tex. 77024

[21] Appl. No.: 888,837

[22] Filed: Mar. 22, 1978

[51] Int. Cl.[2] ..... E21B 17/00

[52] U.S. Cl. ..... 175/320; 175/61; 64/1 R

[58] Field of Search ..... 175/61, 320, 321; 64/1 R

[56] References Cited

U.S. PATENT DOCUMENTS

| | | | |
|---|---|---|---|
| 3,382,938 | 5/1968 | Williams, Jr. | 175/61 X |
| 3,391,749 | 7/1968 | Arnold | 175/320 X |
| 3,880,246 | 4/1975 | Farris | 175/61 |
| 4,068,730 | 1/1978 | Arnold | 175/320 |

*Primary Examiner*—Ernest R. Purser
*Assistant Examiner*—Nick A. Nichols, Jr.

[57] ABSTRACT

A drill collar string is provided for use in the drilling of a well. The string comprises a plurality of drill collars having straight tubular sections vertically spaced apart along the length of the string. Each of the sections are weight relieved along one side thereof to produce an eccentric weighting of the sections such that they act to maintain the drill collar string so that it has little, if any, rubbing contact with the sides of the borehole. Such a drill collar string is also provided with a lowermost drill collar which is likewise eccentrically weighted so that the overall combination can increase drilling rates over those afforded by standard slick drill collars and winged stabilizers.

12 Claims, 3 Drawing Figures

SPACED WEIGHT RELIEVED DRILL COLLAR STRING

This invention relates to a stabilized drill collar string including dynamic stabilizers and also to such a string which includes an eccentrically weighted collar of the type shown and described in my U.S. Pat. No. 4,068,730, issued Jan. 17, 1978, which is incorporated herein in its entirety by reference thereto.

Heretofore in the drilling of wells, it has been conventional to add one or more stabilizers to the drill string; that is, to the string of drill collars which form the lower terminus of the drill string. These stabilizers have almost universally been formed as tubular sections having one or more blades which protruded from the tubular sections to bear against the walls of the borehole and thereby, hopefully, hold the drill collar string out of contact with such walls. In many cases, the blades were attached to a sub in the drill collar string so that the blades rotated with the drill string. As a result, the blades tended to enlarge the hole and in any event, were subjected to excessive wear due to their rubbing on the borehole walls. All of this, naturally, resulted in frictions between the drill string and the borehole. Also, in many formations, such as those in South Louisiana, the stabilizers tended to "ball up" with gumbo and other heavy clays thereby impeding circulation of drilling fluid past the stabilizers and also tending to give a swabbing action when making a trip. As is well known, such swabbing action can cause intrusion of formation fluids into the mud column thereby increasing the tendency toward blowouts.

It is an object of this invention to provide a drill collar string with vertically spaced dynamic stabilizers which stabilize the string with a minimum of contact, if any, with the sides of the borehole.

Another object is to provide such a drill collar string which is substantially maintained out of contact with the walls of the borehold by a series of stabilizer sections which do not in themselves contact the walls of the borehole in order to achieve their stabilizing function.

Another object is to provide such a drill collar string having relatively short sections eccentrically weighted so that rotation of the string tends to keep the entire string out of excessive contact with the walls of the borehole without relying on blades for that purpose.

Another object is to provide such a drill collar string in which the lowermost collar is likewise eccentrically weighted so as to enhance the drilling capabilities of the entire string.

Other objects, advantages and features of the invention will be apparent to one skilled in the art upon studying the following specification and drawings wherein.

Figure 1:
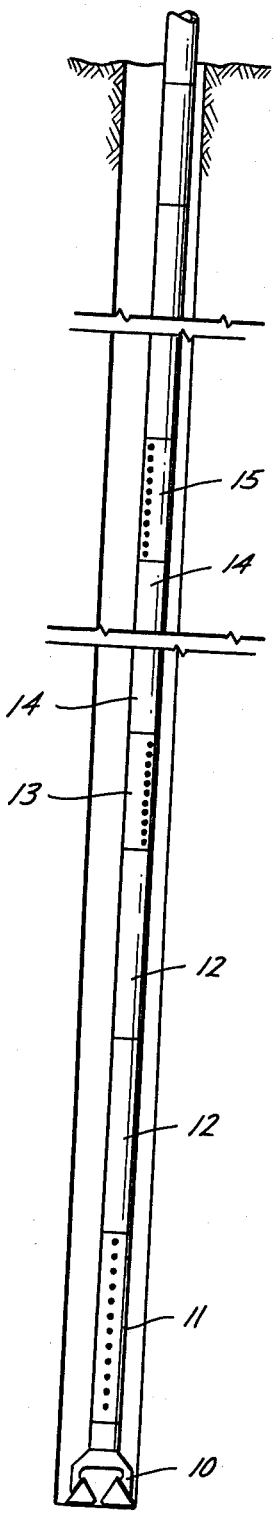
FIG. 1 is a schematic of a well drilling apparatus embodying the invention.

Referring now to FIG. 1, a conventional drilling bit 10 is shown mounted on the end of a string of drill collars. In the illustrated embodiment, the lowermost collar 11 of the string is attached to the bit and is preferably an eccentrically weighted collar made and used in accordance with my U.S. Pat. No. 4,068,730 mentioned above. One or more "slick" collars (i.e., symmetrically weighted about their axis) 12 are mounted at the upper end of the eccentrically weighted collar 11. Disposed above these "slick" collars is a dynamic stabilizer 13, described in detail below. In turn, one or more (e.g., three) "slick" collars 14 are above stabilizer 13 followed by another dynamic stabilizer 15, and so on up the hole as may be desired.

The exact number and mix of the "slick" collars and dynamic stabilizers can be varied to suit local drilling conditions and, in general, a dynamic stabilizer can be situated in the drill string in the same relative locations as were conventional blade type stabilizers where the purpose is to stabilize the drill string. In one particular well, a satisfactory configuration was, starting at the bottom, a drill bit, an eccentrically weighted collar, a "slick" collar, a shock absorber, a "slick" collar, a dynamic stabilizer, three "slick" collars, a second dynamic stabilizer, three more "slick" collars, a third dynamic stabilizer and, finally, four more "slick" collars.

In this well with the above drill collar string configuration, the drilling rate averaged about 48 feet per hour. In an offset well, the same configurations with the dynamic stabilizers being replaced by convential blade stabilizers, the drilling rate was from 28 to 30 feet per hour. In still another offset, a standard string of "slick" collars and bladed stabilizers resulted in a drilling rate of 20 to 21 feet per hour. This substantial increase in drilling rate may not be achieved in all wells under all conditions, but it has been realized in this particular well and increases in some degree may be realized in other wells.

In one experiment, several thousand feet of hole were drilled using dynamic stabilizers which had a shallow thread cut on their outer surface to accentuate any wear. Very slight wearing was observed at the pin end of the stabilizers only, and this was only sufficient to dull the crests of the teeth. As a result of this test, it was concluded that only a fraction of the circumference of the stabilizers was contacting the wall of the borehole and this contact was minimal and for all practical purposes, could be ignored.

Figure 2:
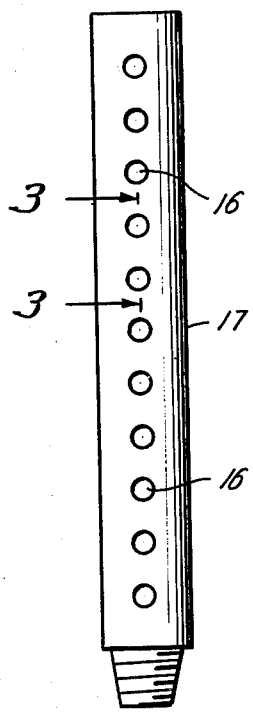
FIG. 2 is a side elevational view of a preferred dynamic stabilizer in accordance with this invention.
Figure 3:
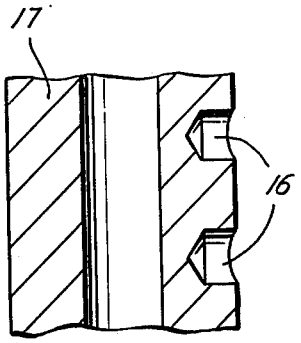
FIG. 3 is a sectional view taken on the line 3—3 of FIG. 2.

As illustrated in FIGS. 2 and 3, the eccentric weighting of the dynamic stabilizers is provided by a line of blind holes 16 drilled into one side of a tubular member 17 which is preferably of the same outside and inside diameter as the drill collars. As will be seen, the line of holes is on one side only of the tubular member. The number of holes and their size and depth can be regulated so that the amount of weight removed from the tubular member is within the range of one-half to ten, preferably three to five percent of the original weight of the tubular member.

Although the mode of weight reduction has been illustrated as drilled holes, the relief can take other forms such as slots, grooves, etc.

The particular stabilizer shown in FIGS. 2 and 3 was made from a short (six-foot) section of drill collar stock and eleven holes were distributed along its length.

Although the dynamic stablizer is shown as a sub separate from the drill collars, it can be an integral part of a collar by placing the holes as a group along a short section of the collar.

The invention having been described, what is claimed is:

1. For use in the drilling of a well, a string of drill collars adapted to be connected in a drill string, said drill collar string having its weight symmetrically disposed about its centerline except for a plurality of straight tubular sections vertically spaced apart along its length with a major portion of said sections being separated by at least one drill collar which has its weight symmetrically disposed about its centerline as aforesaid and each section being weight relieved along one side thereof to produce an eccentric weighting of the section corresponding to 0.5 to 10 percent of the original weight of said section.

2. The string of claim 1 wherein the weight removed from said sections is in the range of 3 to 5 percent.

3. The string of claim 1 wherein said sections have a smooth cylindrical outer surface without any protrusions therefrom.

4. The string of claim 3 wherein a plurality of drilled blind holes in and spaced along one side of the sections provide the weight removed.

5. The string of claim 1 wherein the tubular sections are each individual tubular members screwed into the string of collars.

6. The string of claim 5 wherein the individual tubular members are made up into the string of collars without regard to their orientation to each other.

7. For use in the drilling of a well, a string of drill collars adapted to be connected at its upper and lower ends respectively to the lower end of a drill pipe and to a bit, the lowermost drill collar connected to the bit being weight relieved along one side thereof to produce an eccentric weighting on opposite sides thereof corresponding to one-half to ten percent of the original weight of such collar; the collars above said lowermost collar having their weight symmetrically disposed about their centerline except for a plurality of sections vertically spaced apart along the length of such collars each of which sections is weight relieved along one side thereof to produce an eccentric weighting of each section corresponding to one-half to ten percent of the original weight of each section.

8. The string of claim 7 wherein the weight removed from said sections is in the range of three to five percent.

9. The string of claim 7 wherein the sections and the lowermost drill collar have a smooth cylindrical outer surface without any protrusions therefrom.

10. The string of claim 9 wherein a plurality of drilled blind holes in and spaced along one side of the sections and of the lowermost collar provide the weight removed.

11. The string of claim 7 wherein the tubular sections are each individual tubular members screwed into the string of collars.

12. The string of claim 11 wherein the individual tubular members are made up into the string of collars without regard to their orientation to each other.

* * * * *